US011594126B2

(12) United States Patent
Guo et al.

(10) Patent No.: US 11,594,126 B2
(45) Date of Patent: Feb. 28, 2023

(54) SYSTEMS AND METHODS FOR A TRAFFIC FLOW MONITORING AND GRAPH COMPLETION SYSTEM

(71) Applicant: Toyota Motor Engineering & Manufacturing North America, Inc., Plano, TX (US)

(72) Inventors: Rui Guo, San Jose, CA (US); Hongsheng Lu, San Jose, CA (US); Ahmed H. Sakr, Mountain View, CA (US); Prashant Tiwari, Santa Clara, CA (US)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 234 days.

(21) Appl. No.: 17/005,824

(22) Filed: Aug. 28, 2020

(65) Prior Publication Data

US 2022/0068123 A1 Mar. 3, 2022

(51) Int. Cl.

| | |
|---|---|
| ***G08G 1/00*** | (2006.01) |
| ***G08G 1/01*** | (2006.01) |
| ***G08G 1/056*** | (2006.01) |

(52) U.S. Cl.

CPC ..... *G08G 1/0145* (2013.01); *G08G 1/012* (2013.01); *G08G 1/0125* (2013.01); *G08G 1/0141* (2013.01); *G08G 1/056* (2013.01)

(58) Field of Classification Search

None

See application file for complete search history.

(56) References Cited

U.S. PATENT DOCUMENTS

| | | | |
|---|---|---|---|
| 8,930,123 | B2 | 1/2015 | Srivastava |
| 2019/0279247 | A1 | 9/2019 | Finken et al. |

(Continued)

FOREIGN PATENT DOCUMENTS

| | | | |
|---|---|---|---|
| CN | 103064974 | A | 4/2013 |
| CN | 105243841 | A | 1/2016 |

(Continued)

OTHER PUBLICATIONS

Li et al., "The Study of Traffic Flow Information Completion Based on GAN Algorithm," 2018 IEEE 7th Data Driven Control and Learning Systems Conference (DDCLS), May 2018, pp. 1185-1190.

(Continued)

*Primary Examiner* — James M McPherson

(74) *Attorney, Agent, or Firm* — Christopher G. Darrow; Darrow Mustafa PC

(57) ABSTRACT

System, methods, and other embodiments described herein relate to improving monitoring of traffic flows. In one embodiment, a method includes aggregating perception data associated with a road network from information sources to a server over a network. The method also includes generating a graph structure from the perception data in association with a neural network model. The graph structure is an incomplete representation of the road network in view of missing data. The method also includes completing the graph structure using the neural network model that forms a graph model of the traffic flows to de-noise the graph structure according to road constraints between two points in the road network. The method also includes communicating the graph model of the traffic flows to a vehicle to navigate traffic in the road network.

20 Claims, 7 Drawing Sheets

(56) References Cited

U.S. PATENT DOCUMENTS

| | | | | |
|---|---|---|---|---|
| 2021/0301479 | A1* | 9/2021 | Weiler | G06Q 10/0637 |
| 2021/0407284 | A1* | 12/2021 | Li | G08G 1/0116 |

FOREIGN PATENT DOCUMENTS

| | | | |
|---|---|---|---|
| CN | 105679022 | A | 6/2016 |
| CN | 105913654 | A | 8/2016 |
| CN | 110164151 | A | 8/2019 |
| CN | 110444028 | A | 11/2019 |
| WO | 2019213763 | A1 | 11/2019 |
| WO | 2019220353 | A2 | 11/2019 |

OTHER PUBLICATIONS

Kipf et al., "Variational Graph Auto-Encoders," Nov. 21, 2016, pp. 1-3, arXiv:1611.07308v1 [stat.ML].

* cited by examiner

SYSTEMS AND METHODS FOR A TRAFFIC FLOW MONITORING AND GRAPH COMPLETION SYSTEM

TECHNICAL FIELD

The subject matter described herein relates, in general, to a traffic system, and, more particularly, to a traffic system for improving monitoring of traffic flows by using a graph model of traffic flows from aggregated perception data.

BACKGROUND

Vehicles may be equipped with sensors that facilitate perceiving other vehicles, obstacles, pedestrians, and additional aspects in an intelligent transportation system (ITS). A traffic system may generate traffic flow information using sensors and fixed roadside unit (RSU) data. Examples of traffic flow information may include the vehicle states on the road, an intersection layout, traffic light positions, or stop-n-go profiles. Vehicles may use traffic flow information to avoid traffic congestion, construction, and accidents. Vehicles avoiding traffic congestion may reduce pollution, increase operator satisfaction, reduce vehicle wear, and so on.

Moreover, a traffic system may need accurate, reliable, and complete data for real-time traffic flow monitoring in an ITS. However, a traffic system may receive erroneous data due to missing, incomplete, or lost data from vehicle sensors, fixed RSUs, operators, and so on in a large-scale road network. For example, the traffic flow data collected from a fixed RSU may have high noise, missing data, high-error data, and so on. A traffic system may have difficulty with traffic analysis, routing, and planning using traffic flow information that includes erroneous data. Thus, current traffic system constraints may limit the benefits and capabilities of traffic flow information for intelligent traffic management.

Furthermore, current traffic flow monitoring systems rely on fixed RSUs in limited geographic areas and vehicle counters. For example, a graph of traffic flows generated by a monitoring system may have gaps when combining raw vehicle counting data and fixed RSU data. An ITS may be unable to scale real-time traffic flow monitoring using error-prone fixed RSUs and vehicle counters that may fail often. Thus, a traffic system may be ineffective at real-time traffic flow monitoring using fixed RSUs, vehicle counters, or other data sources.

SUMMARY

In one embodiment, example systems and methods relate to a manner of improving a traffic system that monitors traffic flows by using a graph model. In various implementations, current traffic systems may generate unreliable traffic flow information by relying on fixed roadside units (RSU) in limited geographic areas, vehicle counters, and so on data. Accordingly, current traffic systems may be unable to scale real-time traffic flow monitoring using unreliable fixed RSUs and vehicle counters. Therefore, in one embodiment, a traffic system graphs a complete model of traffic flows using a trained neural network model according to sensor-rich vehicle (SRV) data aggregated from mobile agents. The traffic system may aggregate the SRV vehicle data using a hierarchy of a connected vehicular platform, vehicle-to-everything (V2X) communication, and a server. In one approach, the traffic system may generate a graph structure from the perception data in association with the neural network model. The resultant graph structure may be an incomplete representation of the road network due to incomplete or missing perception data. Accordingly, the traffic system may complete the graph structure using the trained neural network model to form a reliable graph model of the traffic flows. In this way, a traffic system may provide complete and accurate traffic flow information to vehicles, operators, and service providers in an ITS thereby improving congestion, operator satisfaction, and efficiency.

In one embodiment, a traffic system for improving monitoring of traffic flows is disclosed. The traffic system includes one or more processors and a memory communicably coupled to the one or more processors. The memory stores an aggregation module including instructions that when executed by the one or more processors cause the one or more processors to aggregate perception data associated with a road network from information sources to a server over a network. The memory also stores a graphing module including instructions that when executed by the one or more processors cause the one or more processors to generate a graph structure from the perception data in association with a neural network model, wherein the graph structure is an incomplete representation of the road network in view of missing data associated with the information sources. The graphing module also includes instructions to complete the graph structure using the neural network model that forms a graph model of the traffic flows, wherein completion of the graph structure includes using the neural network model to de-noise the graph structure according to road constraints between two points in the road network. The graphing module also includes instructions to communicate the graph model of the traffic flows to a vehicle to navigate traffic in the road network associated with the graph model.

In one embodiment, a non-transitory computer-readable medium for the improving monitoring of traffic flows and including instructions that when executed by one or more processors cause the one or more processors to perform one or more functions is disclosed. The instructions include instructions to aggregate perception data associated with a road network from information sources to a server over a network. The instructions also include instructions to generate a graph structure from the perception data in association with a neural network model, wherein the graph structure is an incomplete representation of the road network in view of missing data associated with the information sources. The instructions also include instructions to complete the graph structure using the neural network model that forms a graph model of the traffic flows, wherein completion of the graph structure includes using the neural network model to de-noise the graph structure according to road constraints between two points in the road network. The instructions also include instructions to communicate the graph model of the traffic flows to a vehicle to navigate traffic in the road network associated with the graph model.

In one embodiment, a method for improving monitoring of traffic flows is disclosed. In one embodiment, the method includes aggregating perception data associated with a road network from information sources to a server over a network. The method also includes generating a graph structure from the perception data in association with a neural network model, wherein the graph structure is an incomplete representation of the road network in view of missing data associated with the information sources. The method also includes completing the graph structure using the neural network model that forms a graph model of the traffic flows, wherein completing the graph structure includes using the neural network model to de-noise the graph structure according to road constraints between two points in the road network. The method also includes communicating the graph model of the traffic flows to a vehicle to navigate traffic in the road network associated with the graph model.

BRIEF DESCRIPTION OF THE DRAWINGS

The accompanying drawings, which are incorporated in and constitute a part of the specification, illustrate various systems, methods, and other embodiments of the disclosure. It will be appreciated that the illustrated element boundaries (e.g., boxes, groups of boxes, or other shapes) in the figures represent one embodiment of the boundaries. In some embodiments, one element may be designed as multiple elements or multiple elements may be designed as one element. In some embodiments, an element shown as an internal component of another element may be implemented as an external component and vice versa. Furthermore, elements may not be drawn to scale.

DETAILED DESCRIPTION

Systems, methods, and other embodiments associated with a traffic system improving the monitoring of traffic flows are disclosed herein. A traffic system may form a reliable graph model of traffic flows to reduce congestion and improve vehicle navigation. In one approach, a server of the traffic system provides a reliable and accurate graph model of traffic flows to vehicles by completing a graph structure about a road network using aggregated perception data from a hierarchical vehicular network. The hierarchy of perception data sources may include sensor-rich vehicle (SRV) data, fixed roadside unit (RSU) data, traffic cameras, and/or edge servers. For example, the perception data of a vehicle may include information relating to surrounding environmental conditions or states of other vehicles.

The aggregated perception data may include erroneous data having errors due to noise, lost data, or missing data making accurate traffic flow modeling challenging. Accordingly, the traffic system may generate the graph structure from the aggregated perception data in association with a neural network model and encoded road link constraints for a more accurate representation. In one approach, a road link may be a path between two or more traffic intersections in a road network. A constraint may limit, reduce, or refine a prediction space for data optimization thereby improving prediction accuracy and speed. For example, the road link information may include details of driving conditions, road constraints, map constraints, traffic incidents, and so on. In this way, the traffic system using the neural network model may produce an accurate graph structure using erroneous perception data from the information sources by leveraging constraints to improve estimation or prediction.

In addition, the traffic system may complete the graph structure by de-noising or minimizing errors associated with the perception data and the erroneous data using the trained neural network model. The traffic system may also de-noise the graph structure by relying on the road link constraints to improve prediction results. In particular, the traffic system may improve prediction and completion outcomes for erroneous perception data by training the neural network model. In one approach, a neural network model may use a complete ground-truth of perception data as training data. The weights of a parameterized encoder-decoder network may be updated for mapping the perception data to filter out noise values and fill-in missing values to structure, complete, or clean a graph structure of perception data. In this way, a traffic system may provide a complete and accurate graph model of traffic flows to vehicles, operators, and service providers in an ITS thereby improving congestion, operator satisfaction, and efficiency.

Figure 1:
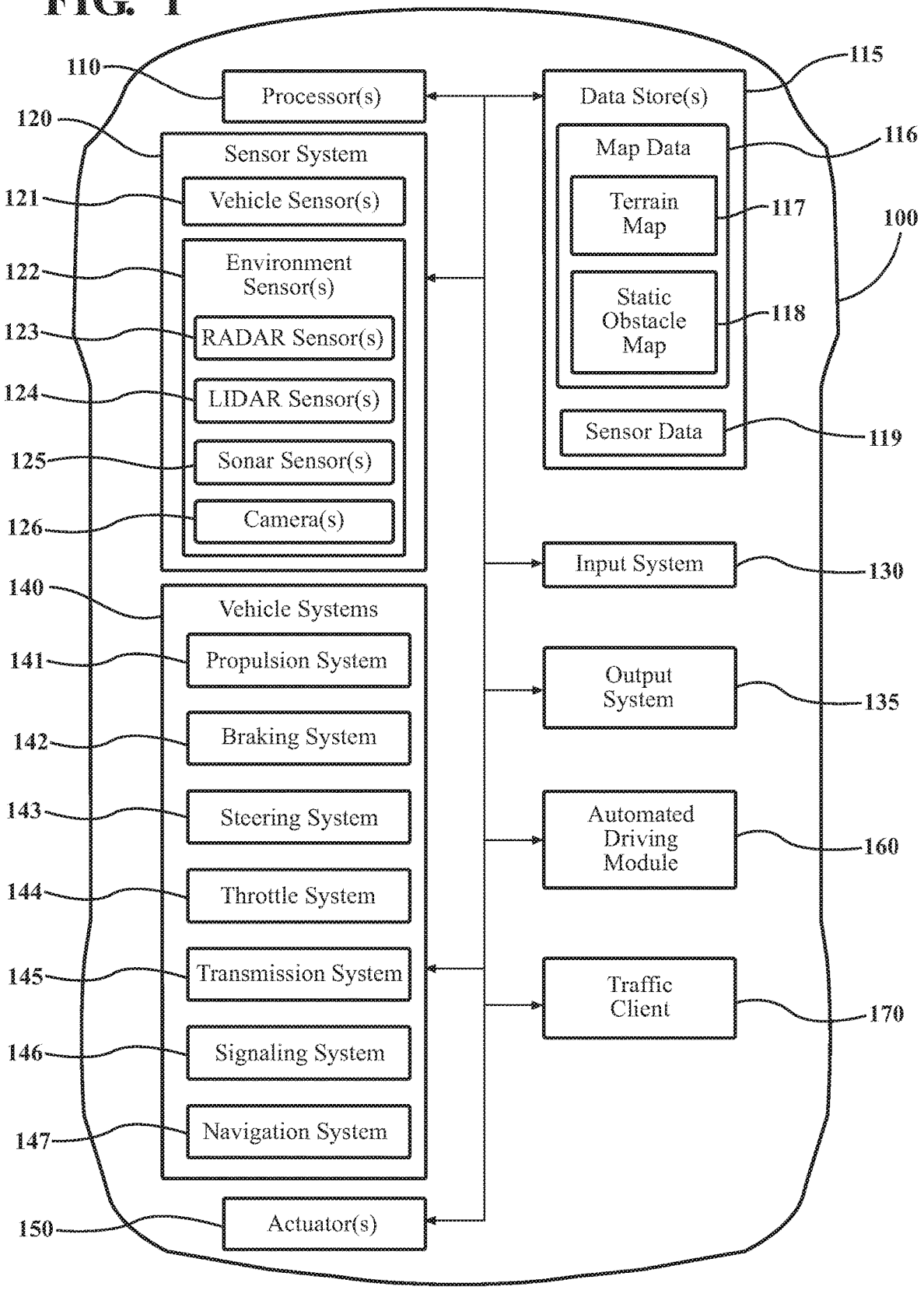
FIG. 1 illustrates one embodiment of a vehicle within which systems and methods disclosed herein may be implemented.

Referring to FIG. 1, an example of a vehicle 100 is illustrated. As used herein, a "vehicle" is any form of motorized transport. In one or more implementations, the vehicle 100 is an automobile. While arrangements will be described herein with respect to automobiles, it will be understood that embodiments are not limited to automobiles. In some implementations, the vehicle 100 may be any robotic device or form of motorized transport that, for example, includes sensors to perceive aspects of the surrounding environment, and thus benefits from the functionality discussed herein associated with improving monitoring of traffic flows by completing or auto-completing a graph model of traffic flows using a graph structure of aggregated perception data. In particular, a system may form the graph structure in association with a neural network model and complete the graph model of traffic flows using the neural network model.

Moreover, the vehicle 100 also includes various elements. It will be understood that in various embodiments it may not be necessary for the vehicle 100 to have all of the elements shown in FIG. 1. The vehicle 100 can have any combination of the various elements shown in FIG. 1. Further, the vehicle 100 can have additional elements to those shown in FIG. 1. In some arrangements, the vehicle 100 may be implemented without one or more of the elements shown in FIG. 1. While the various elements are shown as being located within the vehicle 100 in FIG. 1, it will be understood that one or more of these elements can be located external to the vehicle 100. Further, the elements shown may be physically separated by large distances. For example, as discussed, one or more components of the disclosed system can be implemented within a vehicle while further components of the system are implemented in a system that is remote from the vehicle 100.

Some of the possible elements of the vehicle 100 are shown in FIG. 1 and will be described along with subsequent figures. However, a description of many of the elements in FIG. 1 will be provided after the discussion of FIGS. 2-7 for purposes of brevity of this description. Additionally, it will be appreciated that for simplicity and clarity of illustration, where appropriate, reference numerals have been repeated among the different figures to indicate corresponding or analogous elements. In addition, the discussion outlines numerous specific details to provide a thorough understanding of the embodiments described herein. Those of skill in the art, however, will understand that the embodiments described herein may be practiced using various combinations of these elements. In either case, a traffic system 200 that is implemented to perform methods and other functions as disclosed herein improves monitoring of traffic flows by completing, auto-completing, or cleaning a graph model of traffic flows in a geographic area. As will be discussed in greater detail subsequently, the traffic system 200, in various embodiments, is implemented partially within the vehicle 100, and as a server or a cloud-based service.

Figure 2:
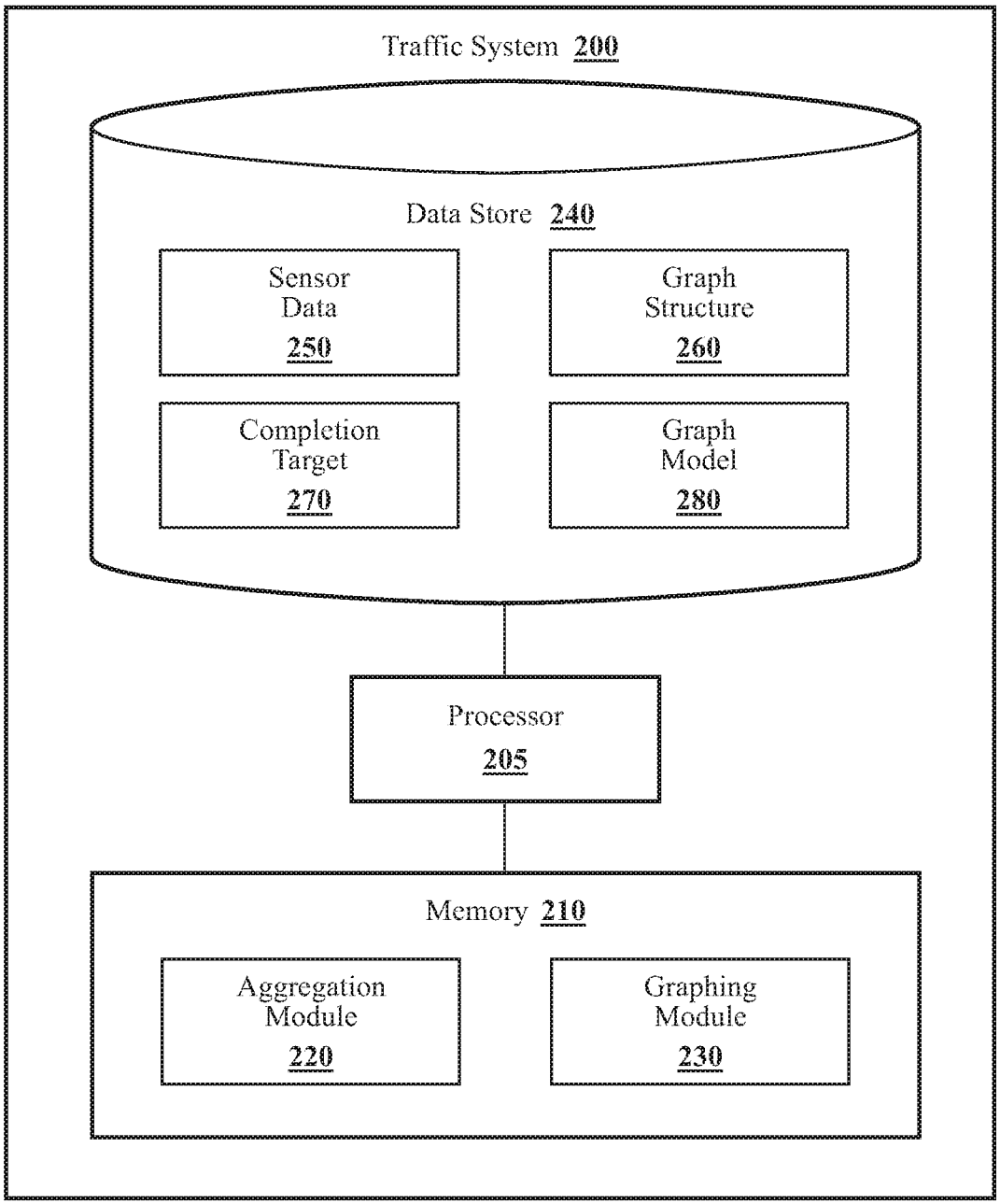
FIG. 2 illustrates one embodiment of a traffic system 200 that monitors traffic flows using a graph model of traffic flows by completing a graph structure.

FIG. 2 illustrates one embodiment of a traffic system 200 that monitors traffic flows using a graph model of traffic flows by completing a graph structure. The traffic system 200 is shown as including a processor 205. In one embodiment, the traffic system 200 includes a memory 210 that stores an aggregation module 220 and a graphing module 230. The memory 210 may be a random-access memory (RAM), read-only memory (ROM), a hard-disk drive, a flash memory, or other suitable memory for storing the modules 220 and 230. The modules 220 and 230 are, for example, computer-readable instructions that when executed by the processor 205 cause the processor 205 to perform the various functions disclosed herein.

The traffic system 200 as illustrated in FIG. 2 may be generally an abstracted form of the traffic system 200 as may be implemented in a server, an edge server, a cloud computing system, and/or in part in the vehicle 100. For example, the vehicle 100 may include a traffic client 170 that may communicate perception data to the traffic system 200. The traffic system 200 may use the perception data to complete a graph model of the traffic flows and communicate the graph model to the vehicle 100, thereby improving traffic, congestion, navigation, automated driving maneuvers, automated motion plans, and so on.

With reference to FIG. 2, the aggregation module 220 generally includes instructions that may function to control the processor 205 to aggregate perception data, fixed RSU data, and so on from various sources in a geographic area. As provided for herein, the aggregation module 220, in one embodiment, may acquire sensor data 250 that includes at least the sensor data 119, camera images, range measurements, and so on. In further arrangements, the aggregation module 220 may acquire the sensor data 250 from further sensors such as radar sensors 123, a light detection and ranging (LIDAR) sensor 124, and other sensors as may be suitable to determine the perception of a geographic area.

The aggregation module 220 may undertake various approaches to fuse data from multiple sensors when providing the sensor data 250 and/or from sensor data acquired over a wireless communication link. Thus, the sensor data 250, in one embodiment, may represent a combination of perceptions acquired from multiple sensors.

Moreover, in one embodiment, the traffic system 200 includes a data store 240. In one embodiment, the data store 240 is a database. The database is, in one embodiment, an electronic data structure stored in the memory 210 or another data store and that is configured with routines that can be executed by the processor 205 for analyzing stored data, providing stored data, organizing stored data, and so on. Thus, in one embodiment, the data store 240 stores data used by the modules 220 and 230 in executing various functions. In one embodiment, the data store 240 includes the sensor data 250 along with, for example, metadata that characterize various aspects of the sensor data 250. For example, the metadata can include location coordinates (e.g., longitude and latitude), relative map coordinates or tile identifiers, time/date stamps from when the separate sensor data 250 was generated, and so on.

In one embodiment, the data store 240 may also include the graph structure 260, the completion target 270, and the graph model 280. The traffic system 200 may generate the graph structure 260 according to aggregating structured sensor and perception data from information sources to a server. A graph structure 260 may be a graph that illustrates traffic intersections and vehicle flows in a geographic area. The information sources may be vehicles in an area, a fixed RSU, map data, vehicle-to-infrastructure (V2I) data, vehicle-to-everything (V2X) data, and so on. The traffic system 200 may generate the graph structure 260 using perception data and a neural network model. As further explained herein, the traffic system 200 may generate the graph structure in association with or using a neural network model to estimate or predict any erroneous or missing data points of the perception data.

The traffic system 200 may determine if the graph structure 260 has enough data points or few erroneous data points to meet the completion target 270 threshold or level. For example, in one approach, the traffic system 200 may determine that the graph structure 260 satisfies the completion target 270 if over 90% of traffic intersections are linked in a road network. In another example, the traffic system 200 may determine that the graph structure 260 satisfies the completion target 270 if over 95% of SRVs in the road network reported low-error perception data.

The traffic system 200, according to the satisfaction of the completion target, may generate a completed graph model 280 of traffic flows by completing, auto-completing, cleaning, or correcting data of the graph structure 260. As further explained herein, the traffic system 200 may generate the completed graph model 280 of traffic flows using a neural network model. The traffic system 200 may communicate the completed graph model 280 to vehicles in a geographic area to improve traffic, congestion, navigation, automated driving, and so on.

The aggregation module 220, in one embodiment, is further configured to perform additional tasks beyond acquiring the sensor data 250. For example, the aggregation module 220 includes instructions that cause the processor 205 to aggregate sensor or perception data from information sources to a server. The information sources may be vehicles in a specific area, a fixed RSU, map data, vehicle-to-infrastructure V2I data, V2X data, and so on. Moreover, aggregating perception data may be performed according to a detection model or a measurement model associated with a perception data type. In one approach, the traffic system 200 may generate the graph structure using a confidence score related to a detection model or a measurement model associated with the perception data type. For example, a detection model or measurement model may require that an SRV report a 30 degree side, low-resolution view of a particular intersection every morning.

Moreover, in further embodiments, the aggregation module 220 may acquire sensor data 250 at successive iterations or time steps. Thus, the traffic system 200, in one embodiment, may iteratively execute the functions to be discussed in FIG. 6 at blocks 610 and 620 to acquire the sensor data 250 for graphing. Furthermore, the aggregation module 220, in one embodiment, may execute one or more of the noted functions in parallel for separate observations in order to maintain updated perceptions. Additionally, as previously noted, the aggregation module 220, when acquiring data from multiple sensors, may fuse the data together to form the sensor data 250 and to provide improved perception.

In one embodiment, as explained further herein, the aggregation module 220 includes instructions that cause the processor 205 to aggregate perception data from a plurality of information sources to a server over a wired or wireless network. Concerning the graphing module 230, it should be appreciated that the graphing module 230 in combination with the traffic system 200 can form a computational model such as a machine learning model, a deep learning model, a neural network model, or another similar approach to form a graph structure from data, complete a graph model of traffic flows, clean a graph of traffic flows, and so on.

Figure 3:
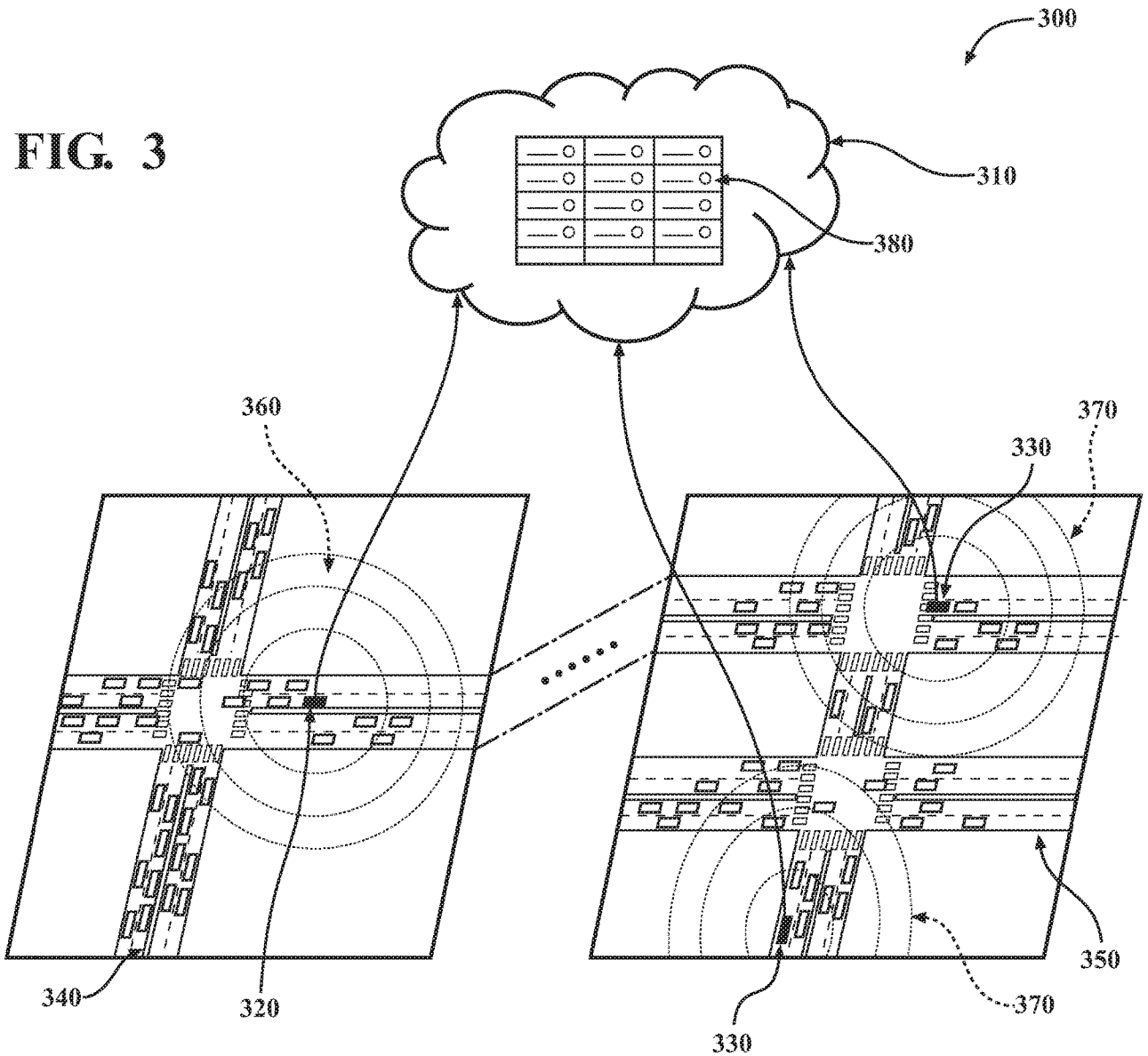
FIG. 3 illustrates one embodiment of a traffic system that aggregates perception data from mobile and fixed information sources.

Regarding aggregating perception data, FIG. 3 illustrates one embodiment of a traffic system 300 that aggregates perception data from mobile and fixed information sources. The traffic system 300 may include a server, an edge server, a remote server, a cloud server, and so on 310 that connects to multiple sensor-rich vehicles (SRV) 320 or 330 in the road networks 340 or 350. The road networks 340 or 350 may include vertical or horizontal traffic flows of vehicles. An SRV may be an intelligent connected vehicle, such as the vehicle 100, that is equipped with one or more smart sensor(s), camera(s), radar, LIDAR, and so on.

The SRV may also be a mobile agent that uses equipment to proactively or pervasively sense the surrounding environment, detect objects of interest, count objects, measure traffic dynamics, calculate traffic dynamics, and so on. For example, traffic dynamics may include traffic speed, flow rates, traffic density, traffic occupancy, traffic congestion, and so on. The SRV may associate detected data, measured data, calculated data, and so on with a confidence score, a confidence interval, or a confidence model. In one approach, the server 310 may weigh or factor received data from an SRV to generate the graph structure 260 according to the confidence score, the confidence interval, or the confidence model.

In addition, the SRVs 320 or 330 may update different types of traffic or traffic flow information at a certain framing frequency, time, location, and so on. For example, the SRVs 320 or 330 may select a framing frequency (e.g., 10 Hz) according to a sensor's refresh frequency, a minimum requirement of a mobile service, a Quality of Service (QoS) parameter, and so on. In one approach, the multiple SRVs 320 or 330 may communicate traffic flow information within sensing ranges 360 and 370, respectively, to the server 310, such as through a car-to-infrastructure (C2X) channel. The traffic flow related information may be associated with the current vehicle states, an intersection layout, traffic light positions, stop-n-go profiles, and so on associated with the road networks 340 or 350. Furthermore, the server 310 may store the traffic flow related information in medium or database 380.

In FIG. 3, the traffic system 300 may associate confidence scores with a frame of traffic information including a timestamp, a geo-location identification, a headway, a direction, and so on. The traffic system 300 may communicate the framed traffic information and confidence scores to the server 310. In one approach, the SRVs 330 may not transmit the framed traffic information if the SRV is running in the middle of a road link. As explained further herein, a road link may be a path or road between two or more traffic intersections in a road network. Instead, the SRVs 330 may transmit the framed traffic information according to a trigger associated with approaching an intersection, a defined node point in a graph, and so on. The SRVs 330 may associate the trigger with a range bounded by the sensing range 370. Correspondingly, a bounded range may provide the server 310 with more localized, tailored, or precise information.

The server 310 may aggregate, collect, or synchronize the received framed traffic information in a geographic area. The server 310 may also aggregate, collect, or synchronize data from fixed RSUs, traffic cameras, vehicle counters, roadside sensors, and so on. In one approach, the server 310 may be a cloud server that processes perception or traffic data using a neural network model to graph, complete, auto-complete, clean, or correct the data for a road network.

The server 310 may aggregate data to reduce the redundancy from multiple messages from a specific area having the same location identification (ID) or direction and the same timestamp reported by more than one SRV. In one approach, the server 310 may fuse the redundant data according to the confidence score associated with each data element. The traffic system 300 may use a confidence score to finalize the data by weighting and normalizing the data. Moreover, the server 310 may differentiate traffic information having the same location but different link ID direction associated with SRVs 320 or 330.

In one approach, the server 310 may communicate traffic flow information in response to an inquiry or a request from different mobility services. For example, a mobility service may be a traffic management client of a large scale city, municipality, or metropolitan area. Furthermore, a traffic client 170 of the vehicle 100 may request traffic flow information for a geographic area to improve navigation, congestion avoidance, automated driving maneuvers, automated motion plans, and so on.

Figure 4:
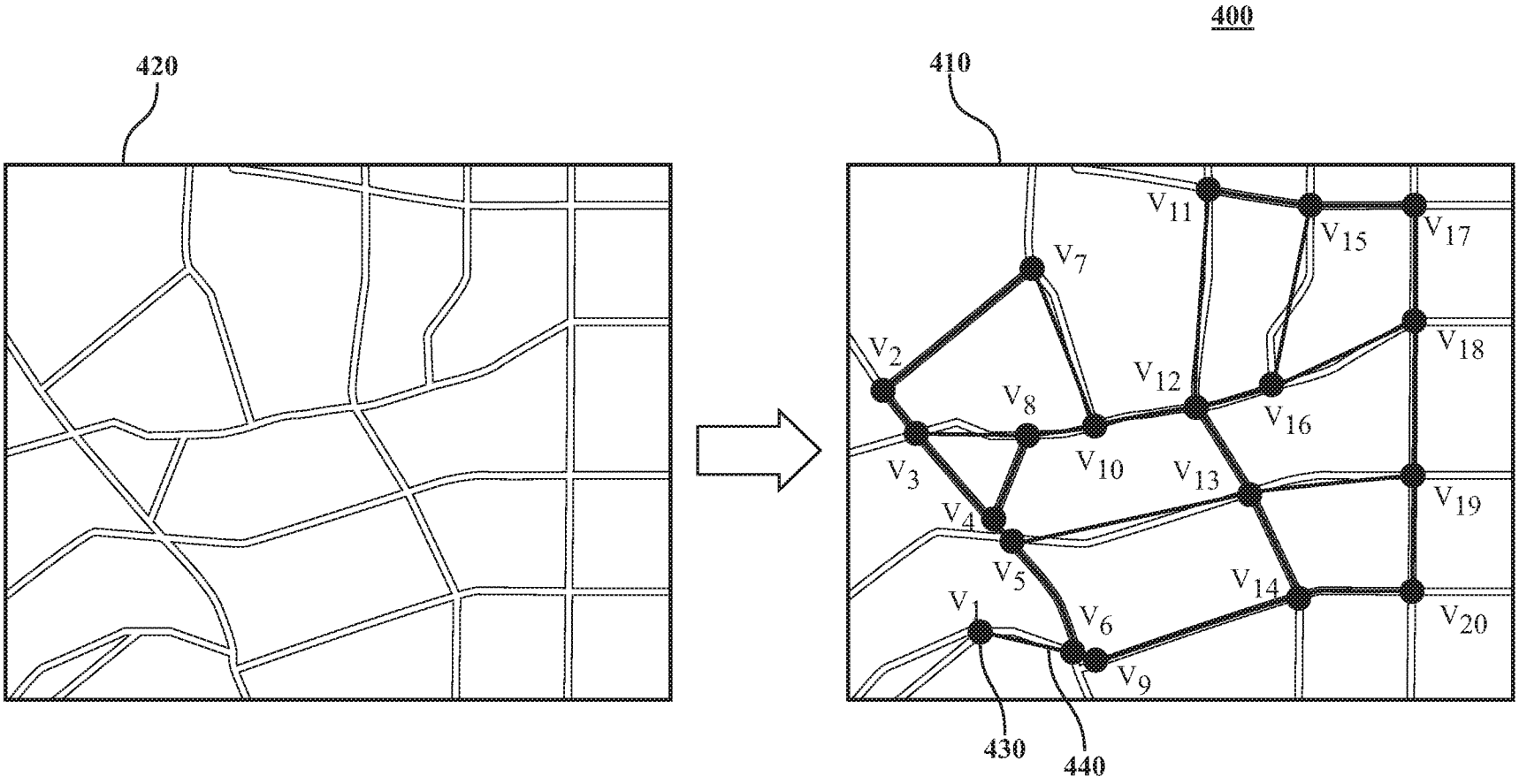
FIG. 4 illustrates one embodiment of a graph structure of perception data for a geographic area.

FIG. 4 illustrates one embodiment of a graph structure of perception data for a geographic area. The traffic system 400 may generate a graph structure from data 410 according to the road network 420 and the traffic information received from SRVs. The graph structure of data 410 may indicate each traffic intersection as a traffic or road link node and vertex 430. For example, the graph structure from data 410 may include $V_1$-$V_{20}$ vertices. Each vertex may be associated with a k-dimension vector or feature that represents reported traffic information from SRVs such as speed, flow rates, density, and so on.

Furthermore, the traffic system 200 may generate the graph structure from data 410 in association with a neural network model that relies on a road link 440 or edge information constraints. A road link or edge information may be a path or road between two or more traffic intersections of $V_1$-$V_{20}$ vertices. A neural network model may improve graphing or mapping data by defining constraints for de-noising. A constraint may limit, reduce, or refine a prediction space for data thereby improving prediction accuracy and speed. For example, the edge information may include details of driving conditions, road constraints, map constraints, traffic incidents, and so on. The edge information may also specify the length between two adjacent nodes as a travel time constraint, a road curvature as a maneuvering constraint, a number of lanes as a road capacity constraint, and so on. In this way, the neural network model may produce a more accurate graph structure from data having erroneous, missing, or noisy perception data via constraints to improve estimation or prediction.

Figure 5:
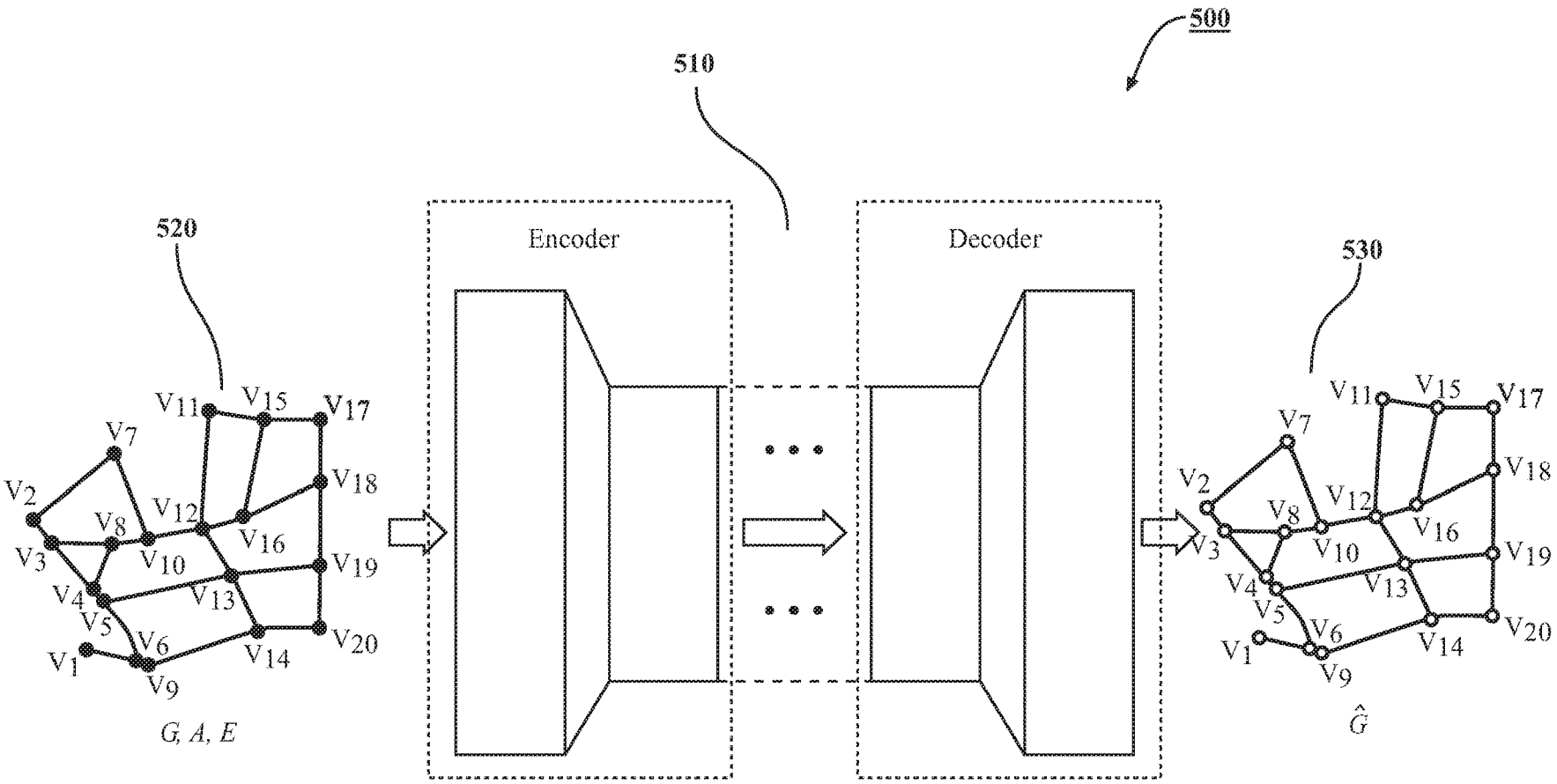
FIG. 5 illustrates one embodiment of a neural network model that generates a graph model of traffic flows in a geographic area by completing and cleaning a graph structure of perception data.

FIG. 5 illustrates one embodiment 500 of a neural network model 510 that generates a graph model of traffic flows in a geographic area by completing and cleaning a graph structure of perception data. The neural network model 510 may use matrices G, A, and E to form a clean and complete graph model of the traffic flows associated with a road network. The neural network model 510 may use a graph structure denoted as a matrix G with the dimensions N×k. The variable N may be the total number of vertices and k the feature vector associated with each vertex. The variable k-dimension may represent reported traffic information from SRVs such as speed, flow rates, density, and so on. A connection relation, such as between vertices, may be represented by an adjacent matrix A with the dimension N×N. In one approach, A may be a binary matrix, where $A_{ij}=1$ represents vertex i connected with vertex j. A may be directional since the road link has one-way traffic or two-way where $A_{ij}\neq A_{ji}$.

In addition, the neural network model 510 may include an edge matrix E with the dimensions N×N×l. The edge matrix E may include a road link attribute, a road link length, a speed limitation of the road link, or a maximum value of the road curvature with the dimension l. Accordingly, a traffic system may use an attribute(s) from the edge matrix E to determine ease of driving on a respective road link, thereby improving automated driving motion plans or navigation.

Moreover, the graph structure of matrix G, adjacent matrix A, and edge matrix E 520 may describe the traffic information and the geometry of the road network. In one approach, once a traffic system creates a representation of the road network, the information in A and E may be fixed or substantially static. A traffic system may have an incomplete or erroneous matrix G with sensed information that includes noise, errors, missing values for a vertex area, missing sensor reports, missing sensor updates, and so on. For example, the missing values for a vertex area may be due to traffic dynamics unreported or missed by an SRV. Thus, the neural network model may generate a graph model of traffic flows in a geographic area by completing, auto-completing, cleaning, or correcting the graph structure of matrix G.

In one approach, the neural network model 510 may be a generative adversarial network (GAN) model using an encoder and decoder structure that takes G, A, and E as inputs. The neural network model 510 may also be a variational (e.g. Bayesian) graph convolution network or graph convolutional GAN. In the encoding processing, the high-dimensional graph structure from data may be mapped multiple times linearly and non-linearly through a layered neural network. As explained further herein, the neural network model 510 may complete, auto-complete, clean, or correct data of the graph structure matrix G and the edge matrix E. Furthermore, the neural network model 510 may use a latent space, that is a lower-dimensional space than the input space, for completing, auto-completing, cleaning, or correcting the graph structure from data of matrix G. The neural network model 510 may inversely decode and re-project back the graph structure from data to the original dimension space to finalize the reconstruction of matrix $\hat{G}$ 530.

In addition, the neural network model 510 may complete, auto-complete, clean, or correct data of the graph structure of matrix G by de-noising to predict, fill-in, or correct erroneous data. In one approach, the neural network model 510 may be self-supervised to learn a manifold of the graph structure from data of matrix G. Concerning the edge matrix E, the neural network model 510 may improve data mapping or completion by defining constraints for de-noising. A constraint may limit, reduce, or refine a prediction space for data thereby improving prediction accuracy and speed. For example, the edge matrix E may include details of driving conditions, road constraints, map constraints, traffic incidents, and so on. The edge matrix E may also specify the length between two adjacent nodes or vertices as a travel time constraint, road curvature as a maneuvering constraint, a number of lanes as a road capacity constraint, and so on. In this way, the neural network model 510 may produce more accurate completion or cleaning of erroneous data associated with matrix G using constraints to improve estimation or prediction.

In one approach, a traffic system may train the neural network model 510 using a completed, cleaned, or corrected ground-truth G, such as for supervised learning. A module may train the neural network model 510 using perception data. By minimizing the error $|\hat{G}-\hat{G}|$ and back-propagating the derivate, the parameterized encoder-decoder network updates their weights to reach a stable point. The neural network model 510 may use the learned parameters or weights for mapping the data to filter out noise values and fill-in or correct missing values to structure, complete, or clean graphed perception data. In this way, the neural network model 510 may generate the reconstruction matrix $\hat{G}$ with satisfactory confidence levels for the completed and cleaned data values when inferred with the noisy and incomplete matrix G.

Figure 6:
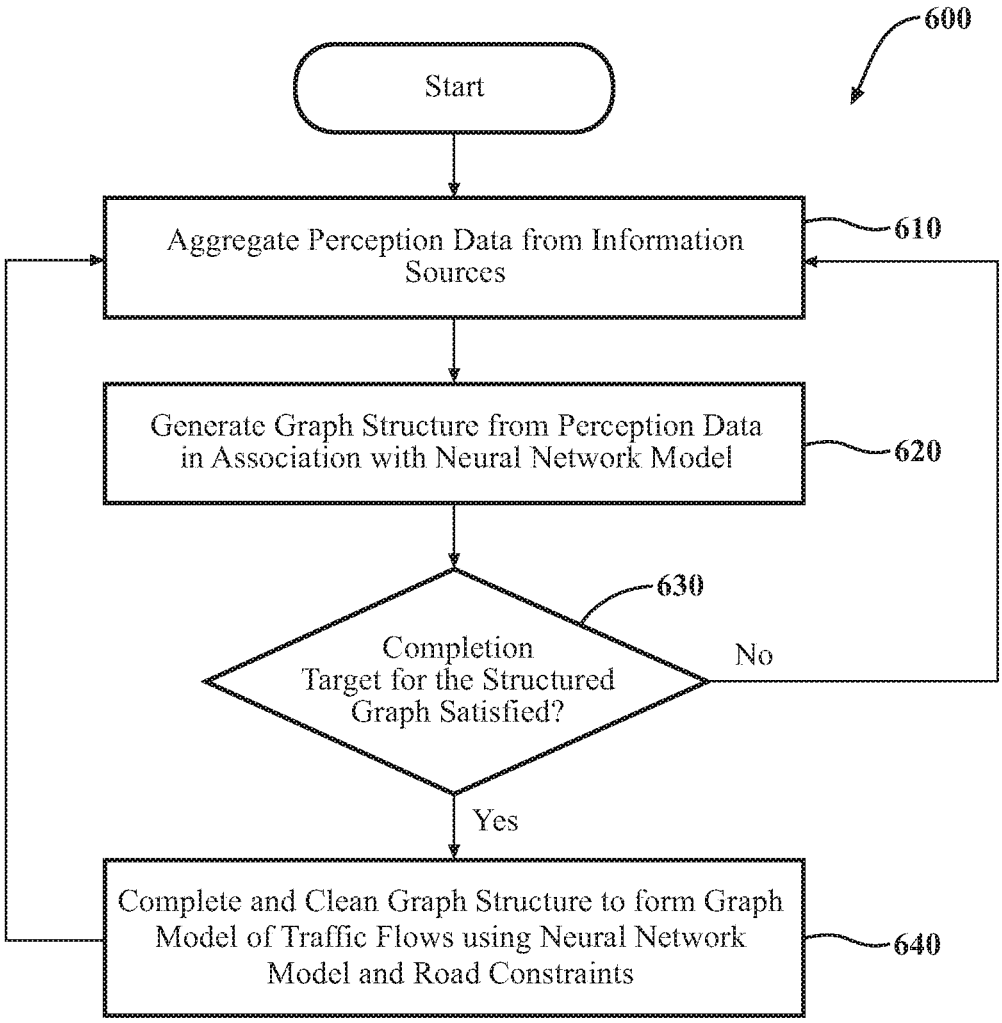
FIG. 6 illustrates one embodiment of a method that is associated with a traffic system that monitors traffic flows by completing a graph structure of a geographic area.

Additional aspects of a traffic system that monitors traffic flows by completing or auto-completing a graph model of traffic flows in a geographic area will be discussed in relation to FIG. 6. FIG. 6 illustrates a flowchart of a method 600 that is associated with a traffic system that monitors traffic flows by completing a graph structure of a geographic area. While method 600 may be discussed in combination with the traffic system 200, it should be appreciated that the method 600 is not limited to being implemented within the traffic system 200 but is instead one example of a system that may implement the method 600.

At 610, the aggregator module 220 aggregates perception data from information sources. In one approach, a server or a cloud server may aggregate the information from mobile agents, SRVs, RSUs, traffic cameras, vehicle counters, road-side sensors, and so on in a road network. The information may include perception data, camera images, range measurements, radar information, LIDAR information, and so on. Furthermore, the server may iteratively or frequently aggregate, collect, synchronize, or frame the received traffic information in a geographic area to prevent data from becoming outdated.

Furthermore, as mentioned herein, the server may aggregate data to reduce the redundancy from multiple messages from a geographic area having the same location ID or direction and the same timestamp reported by more than one SRV. In one approach, the server may also fuse the redundant data according to the confidence score associated with each data element. A traffic system may use a confidence score to finalize the data by weighting and normalizing the data. Moreover, the server 310 may differentiate traffic information having the same location but different link ID direction associated with one or more SRVs.

At 620, the graphing module 230 generates a graph structure from the perception data in association with a neural network model. The graphing module 230 may generate a graph structure from data according to the geographic area or the road network, the aggregated perception data, or road link constraints. In particular, in one approach, the graphing module 230 may use a neural network model that relies on a road link or edge information constraints for more accurate graphing in view of aggregated erroneous perception data. The neural network model may improve graphing or mapping data by defining constraints for de-noising. A constraint may limit, reduce, or refine a prediction space for data thereby improving prediction accuracy and speed. For example, the edge information may include details of driving conditions, road constraints, map constraints, traffic incidents, and so on. In this way, the neural network model may produce a more accurate graph structure using erroneous perception data via constraints to improve estimation or prediction.

At 630, the graphing module 230 determines if the graph structure from perception data satisfies a completion target 270 for the road network. For example, in one approach, the graphing module 230 may determine that the graph structure from perception data satisfies the completion target 270 if over 90% of traffic intersections are linked in the road network. In another example, the graphing module 230 may determine that the graph structure from perception data satisfies the completion target 270 if over 95% of SRVs in the road network reported low-error perception data.

Furthermore, at 640 the graphing module 230 completes, auto-completes, or corrects the erroneous data of the road network in the graph structure from the perception data using the neural network model. In one approach, the graphing module 230 forms a graph model of the traffic flows by using the neural network model to de-noise the perception data according to road constraints between two points in the road network. As explained herein, the neural network model may use constraints for de-noising to limit, reduce, or refine a prediction space for data thereby improving prediction accuracy and speed.

Accordingly, the graphing module 230 using the neural network model may predict, fill-in, or correct erroneous data of the graph structure. In addition, at 640 the graphing module 230 cleans the graph model by error minimization and de-noising for further accuracy at the cost of more processing resources. If the traffic system is unable to produce a graph model of the traffic flows, the method 600 may aggregate more perception data. In this way, the neural network model may produce a more accurate graph model of traffic flows using erroneous perception data via constraints to improve performance for navigation, automated driving, and so on.

Figure 7:
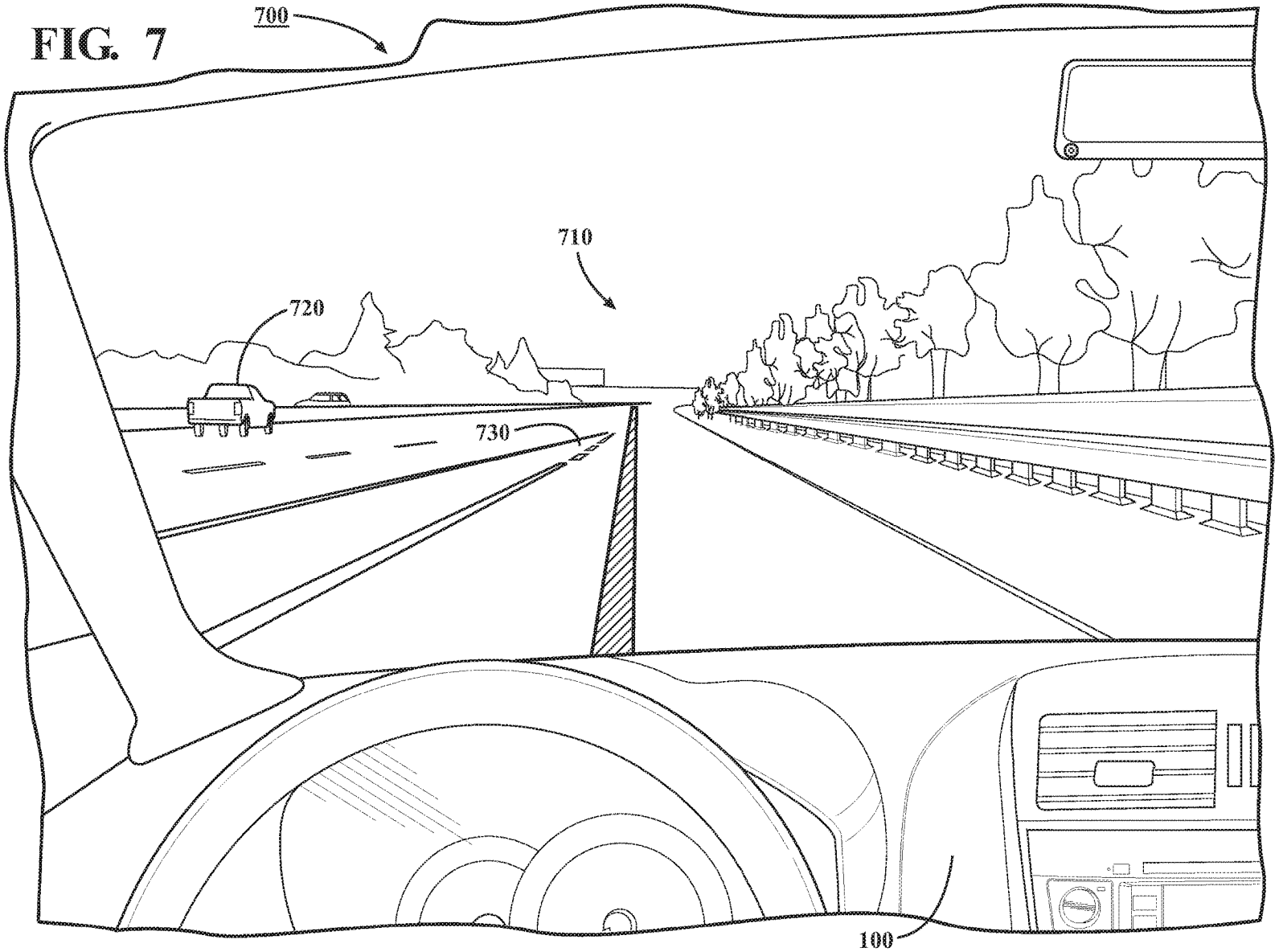
FIG. 7 illustrates a vehicle driving environment that provides perception data to a server and receives a graph model of traffic flows.

Now turning to FIG. 7, the diagram illustrates a vehicle driving environment 700 that provides perception data to a server and receives a graph model of traffic flows. In FIG. 7, a traffic system may aggregate perception data from the vehicle 100 and the vehicle 720. The driving environment 710 may include the vehicle 100 and the vehicle 720 traveling on the expressway 730. In one approach, the traffic system may provide a complete graph model of traffic flows to the vehicle 100 and the vehicle 720. In this way, the traffic system may improve the safety and the reliability of navigation, automated driving, and so on by providing the vehicle 100 and the vehicle 720 the complete and accurate graph model of traffic flows.

FIG. 1 will now be discussed in full detail as an example environment within which the system and methods disclosed herein may operate. In some instances, the vehicle 100 is configured to switch selectively between different modes of operation/control according to the direction of one or more modules/systems of the vehicle 100. In one approach, the modes include: 0, no automation; 1, driver assistance; 2, partial automation; 3, conditional automation; 4, high automation; and 5, full automation. In one or more arrangements, the vehicle 100 can be configured to operate in only a subset of possible modes.

In one or more embodiments, the vehicle 100 is an autonomous or automated vehicle. As used herein, "autonomous vehicle" or "automated vehicle" refers to a vehicle that is capable of operating in an autonomous mode (e.g., category 5, full automation). "Autonomous mode" refers to navigating and/or maneuvering the vehicle 100 along a travel route using one or more computing systems to control the vehicle 100 with minimal or no input from a human driver. In one or more embodiments, the vehicle 100 is highly automated or completely automated. In one embodiment, the vehicle 100 is configured with one or more semi-autonomous operational modes in which one or more computing systems perform a portion of the navigation and/or maneuvering of the vehicle along a travel route, and a vehicle operator (i.e., driver) provides inputs to the vehicle to perform a portion of the navigation and/or maneuvering of the vehicle 100 along a travel route.

The vehicle 100 can include one or more processors 110. In one or more arrangements, the processor(s) 110 can be a main processor of the vehicle 100. For instance, the processor(s) 110 can be an electronic control unit (ECU), and application specific integrated circuit (ASIC), a microprocessor, etc. The vehicle 100 can include one or more data stores 115 for storing one or more types of data. The data store 115 can include volatile and/or non-volatile memory. Examples of suitable data stores 115 include RAM (Random Access Memory), flash memory, ROM (Read Only Memory), PROM (Programmable Read-Only Memory), EPROM (Erasable Programmable Read-Only Memory), EEPROM (Electrically Erasable Programmable Read-Only Memory), registers, magnetic disks, optical disks, and hard drives. The data store 115 can be a component of the processor(s) 110, or the data store 115 can be operatively connected to the processor(s) 110 for use thereby. The term "operatively connected," as used throughout this description, can include direct or indirect connections, including connections without direct physical contact.

In one or more arrangements, the one or more data stores 115 can include map data 116. The map data 116 can include maps of one or more geographic areas. In some instances, the map data 116 can include information or data on roads, traffic control devices, road markings, structures, features, and/or landmarks in the one or more geographic areas. The map data 116 can be in any suitable form. In some instances, the map data 116 can include aerial views of an area. In some instances, the map data 116 can include ground views of an area, including 360-degree ground views. The map data 116 can include measurements, dimensions, distances, and/or information for one or more items included in the map data 116 and/or relative to other items included in the map data 116. The map data 116 can include a digital map with information about road geometry.

In one or more arrangements, the map data 116 can include one or more terrain maps 117. The terrain map(s) 117 can include information about the terrain, roads, surfaces, and/or other features of one or more geographic areas. The terrain map(s) 117 can include elevation data in the one or more geographic areas. The terrain map(s) 117 can define one or more ground surfaces, which can include paved roads, unpaved roads, land, and other things that define a ground surface.

In one or more arrangements, the map data 116 can include one or more static obstacle maps 118. The static obstacle map(s) 118 can include information about one or more static obstacles located within one or more geographic areas. A "static obstacle" is a physical object whose position does not change or substantially change over a period of time and/or whose size does not change or substantially change over a period of time. Examples of static obstacles can include trees, buildings, curbs, fences, railings, medians, utility poles, statues, monuments, signs, benches, furniture, mailboxes, large rocks, or hills. The static obstacles can be objects that extend above ground level. The one or more static obstacles included in the static obstacle map(s) 118 can have location data, size data, dimension data, material data, and/or other data associated with it. The static obstacle map(s) 118 can include measurements, dimensions, distances, and/or information for one or more static obstacles. The static obstacle map(s) 118 can be high quality and/or highly detailed. The static obstacle map(s) 118 can be updated to reflect changes within a mapped area.

The one or more data stores 115 can include sensor data 119. In this context, "sensor data" means any information about the sensors that the vehicle 100 is equipped with, including the capabilities and other information about such sensors. As will be explained below, the vehicle 100 can include the sensor system 120. The sensor data 119 can relate to one or more sensors of the sensor system 120. As an example, in one or more arrangements, the sensor data 119 can include information about one or more LIDAR sensors 124 of the sensor system 120.

In some instances, at least a portion of the map data 116 and/or the sensor data 119 can be located in one or more data stores 115 located onboard the vehicle 100. Alternatively, or in addition, at least a portion of the map data 116 and/or the sensor data 119 can be located in one or more data stores 115 that are located remotely from the vehicle 100.

As noted above, the vehicle 100 can include the sensor system 120. The sensor system 120 can include one or more sensors. "Sensor" means a device that can detect, and/or sense something. In at least one embodiment, the one or more sensors detect, and/or sense in real-time. As used herein, the term "real-time" means a level of processing responsiveness that a user or system senses as sufficiently immediate for a particular process or determination to be made, or that enables the processor to keep up with some external process.

In arrangements in which the sensor system 120 includes a plurality of sensors, the sensors may function independently or two or more of the sensors may function in combination. The sensor system 120 and/or the one or more sensors can be operatively connected to the processor(s) 110, the data store(s) 115, and/or another element of the vehicle 100. The sensor system 120 can produce observations about a portion of the environment of the vehicle 100 (e.g., nearby vehicles).

The sensor system 120 can include any suitable type of sensor. Various examples of different types of sensors will be described herein. However, it will be understood that the embodiments are not limited to the particular sensors described. The sensor system 120 can include one or more vehicle sensors 121. The vehicle sensor(s) 121 can detect information about the vehicle 100 itself. In one or more arrangements, the vehicle sensor(s) 121 can be configured to detect position and orientation changes of the vehicle 100, such as, for example, based on inertial acceleration. In one or more arrangements, the vehicle sensor(s) 121 can include one or more accelerometers, one or more gyroscopes, an inertial measurement unit (IMU), a dead-reckoning system, a global navigation satellite system (GNSS), a global positioning system (GPS), a navigation system 147, and/or other suitable sensors. The vehicle sensor(s) 121 can be configured to detect one or more characteristics of the vehicle 100 and/or a manner in which the vehicle 100 is operating. In one or more arrangements, the vehicle sensor(s) 121 can include a speedometer to determine a current speed of the vehicle 100.

Various examples of sensors of the sensor system 120 will be described herein. The example sensors may be part of the one or more environment sensors 122 and/or the one or more vehicle sensors 121. However, it will be understood that the embodiments are not limited to the particular sensors described.

As an example, in one or more arrangements, the sensor system 120 can include one or more of each of the following: radar sensors 123, LIDAR sensors 124, sonar sensors 125, weather sensors, haptic sensors, locational sensors, and/or one or more cameras 126. In one or more arrangements, the one or more cameras 126 can be high dynamic range (HDR) cameras, stereo or infrared (IR) cameras.

The vehicle 100 can include an input system 130. An "input system" includes components or arrangement or groups thereof that enable various entities to enter data into a machine. The input system 130 can receive an input from a vehicle occupant. The vehicle 100 can include an output system 135. An "output system" includes one or more components that facilitate presenting data to a vehicle occupant.

The vehicle 100 can include one or more vehicle systems 140. Various examples of the one or more vehicle systems 140 are shown in FIG. 1. However, the vehicle 100 can include more, fewer, or different vehicle systems. It should be appreciated that although particular vehicle systems are separately defined, each or any of the systems or portions thereof may be otherwise combined or segregated via hardware and/or software within the vehicle 100. The vehicle 100 can include a propulsion system 141, a braking system 142, a steering system 143, a throttle system 144, a transmission system 145, a signaling system 146, and/or a navigation system 147. Each of these systems can include one or more devices, components, and/or a combination thereof, now known or later developed.

The navigation system 147 can include one or more devices, applications, and/or combinations thereof, now known or later developed, configured to determine the geographic location of the vehicle 100 and/or to determine a travel route for the vehicle 100. The navigation system 147 can include one or more mapping applications to determine a travel route for the vehicle 100. The navigation system 147 can include a global positioning system, a local positioning system or a geolocation system.

The processor(s) 110 and/or the automated driving module(s) 160 can be operatively connected to communicate with the various vehicle systems 140 and/or individual components thereof. For example, returning to FIG. 1, the processor(s) 110 and/or the automated driving module(s) 160 can be in communication to send and/or receive information from the various vehicle systems 140 to control the movement of the vehicle 100. The processor(s) 110 and/or the automated driving module(s) 160 may control some or all of the vehicle systems 140 and, thus, may be partially or fully autonomous as defined by the society of automotive engineers (SAE) 0 to 5 levels.

The processor(s) 110 and/or the automated driving module(s) 160 can be operatively connected to communicate with the various vehicle systems 140 and/or individual components thereof. For example, returning to FIG. 1, the processor(s) 110 and/or the automated driving module(s) 160 can be in communication to send and/or receive information from the various vehicle systems 140 to control the movement of the vehicle 100. The processor(s) 110 and/or the automated driving module(s) 160 may control some or all of the vehicle systems 140.

The processor(s) 110 and/or the automated driving module(s) 160 may be operable to control the navigation and maneuvering of the vehicle 100 by controlling one or more of the vehicle systems 140 and/or components thereof. For instance, when operating in an autonomous mode, the processor(s) 110 and/or the automated driving module(s) 160 can control the direction and/or speed of the vehicle 100. The processor(s) 110 and/or the automated driving module (s) 160 can cause the vehicle 100 to accelerate, decelerate, and/or change direction. As used herein, "cause" or "causing" means to make, force, compel, direct, command, instruct, and/or enable an event or action to occur or at least be in a state where such event or action may occur, either in a direct or indirect manner.

The vehicle 100 can include one or more actuators 150. The actuators 150 can be an element or a combination of elements operable to alter one or more of the vehicle systems 140 or components thereof responsive to receiving signals or other inputs from the processor(s) 110 and/or the automated driving module(s) 160. For instance, the one or more actuators 150 can include motors, pneumatic actuators, hydraulic pistons, relays, solenoids, and/or piezoelectric actuators, just to name a few possibilities.

The vehicle 100 can include one or more modules, at least some of which are described herein. The modules can be implemented as computer-readable program code that, when executed by a processor 110, implement one or more of the various processes described herein. One or more of the modules can be a component of the processor(s) 110, or one or more of the modules can be executed on and/or distributed among other processing systems to which the processor (s) 110 is operatively connected. The modules can include instructions (e.g., program logic) executable by one or more processor(s) 110. Alternatively, or in addition, one or more data store 115 may contain such instructions.

In one or more arrangements, one or more of the modules described herein can include artificial intelligence elements, e.g., neural network, fuzzy logic or other machine learning algorithms. Further, in one or more arrangements, one or more of the modules can be distributed among a plurality of the modules described herein. In one or more arrangements, two or more of the modules described herein can be combined into a single module.

The vehicle 100 can include one or more automated driving modules 160. The automated driving module(s) 160 can be configured to receive data from the sensor system 120 and/or any other type of system capable of capturing information relating to the vehicle 100 and/or the external environment of the vehicle 100. In one or more arrangements, the automated driving module(s) 160 can use such data to generate one or more driving scene models. The automated driving module(s) 160 can determine position and velocity of the vehicle 100. The automated driving module(s) 160 can determine the location of obstacles, obstacles, or other environmental features including traffic signs, trees, shrubs, neighboring vehicles, pedestrians, etc.

The automated driving module(s) 160 can be configured to receive, and/or determine location information for obstacles within the external environment of the vehicle 100 for use by the processor(s) 110, and/or one or more of the modules described herein to estimate position and orientation of the vehicle 100, vehicle position in global coordinates based on signals from a plurality of satellites, or any other data and/or signals that could be used to determine the current state of the vehicle 100 or determine the position of the vehicle 100 with respect to its environment for use in either creating a map or determining the position of the vehicle 100 in respect to map data.

The automated driving module(s) 160 can be configured to determine travel path(s), current autonomous driving maneuvers for the vehicle 100, future autonomous driving maneuvers, and/or modifications to current autonomous driving maneuvers based on data acquired by the sensor system 120, driving scene models, and/or data from any other suitable source such as determinations from the sensor data 250. "Driving maneuver" means one or more actions that affect the movement of a vehicle. Examples of driving maneuvers include: accelerating, decelerating, braking, turning, moving in a lateral direction of the vehicle 100, changing travel lanes, merging into a travel lane, and/or reversing, just to name a few possibilities. The automated driving module(s) 160 can be configured to implement determined driving maneuvers. The automated driving module(s) 160 can cause, directly or indirectly, such autonomous driving maneuvers to be implemented. As used herein, "cause" or "causing" means to make, command, instruct, and/or enable an event or action to occur or at least be in a state where such event or action may occur, either in a direct or indirect manner. The automated driving module(s) 160 can be configured to execute various vehicle functions and/or to transmit data to, receive data from, interact with, and/or control the vehicle 100 or one or more systems thereof (e.g., one or more of vehicle systems 140).

Detailed embodiments are disclosed herein. However, it is to be understood that the disclosed embodiments are intended only as examples. Therefore, specific structural and functional details disclosed herein are not to be interpreted as limiting, but merely as a basis for the claims and as a representative basis for teaching one skilled in the art to variously employ the aspects herein in virtually any appropriately detailed structure. Further, the terms and phrases used herein are not intended to be limiting but rather to provide an understandable description of possible implementations. Various embodiments are shown in FIGS. 1-7, but the embodiments are not limited to the illustrated structure or application.

The flowcharts and block diagrams in the figures illustrate the architecture, functionality, and operation of possible implementations of systems, methods, and computer program products according to various embodiments. In this regard, each block in the flowcharts or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved.

The systems, components and/or processes described above can be realized in hardware or a combination of hardware and software and can be realized in a centralized fashion in one processing system or in a distributed fashion where different elements are spread across several interconnected processing systems. Any kind of processing system or another apparatus adapted for carrying out the methods described herein is suited. A typical combination of hardware and software can be a processing system with computer-usable program code that, when being loaded and executed, controls the processing system such that it carries out the methods described herein. The systems, components and/or processes also can be embedded in a computer-readable storage, such as a computer program product or other data programs storage device, readable by a machine, tangibly embodying a program of instructions executable by the machine to perform methods and processes described herein. These elements also can be embedded in an application product which comprises all the features enabling the implementation of the methods described herein and, which when loaded in a processing system, is able to carry out these methods.

Furthermore, arrangements described herein may take the form of a computer program product embodied in one or more computer-readable media having computer-readable program code embodied, e.g., stored, thereon. Any combination of one or more computer-readable media may be utilized. The computer-readable medium may be a computer-readable signal medium or a computer-readable storage medium. The phrase "computer-readable storage medium" means a non-transitory storage medium. A computer-readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer-readable storage medium would include the following: a portable computer diskette, a hard disk drive (HDD), a solid-state drive (SSD), a ROM, an erasable programmable read-only memory (EPROM or Flash memory), a portable compact disc read-only memory (CD-ROM), a digital versatile disc (DVD), an optical storage device, a magnetic storage device, or any suitable combination of the foregoing. In the context of this document, a computer-readable storage medium may be any tangible medium that can contain, or store a program for use by or in connection with an instruction execution system, apparatus, or device.

Generally, modules as used herein include routines, programs, objects, components, data structures, and so on that perform particular tasks or implement particular data types. In further aspects, a memory generally stores the noted modules. The memory associated with a module may be a buffer or cache embedded within a processor, a RAM, a ROM, a flash memory, or another suitable electronic storage medium. In still further aspects, a module as envisioned by the present disclosure is implemented as an ASIC, a hardware component of a system on a chip (SoC), as a programmable logic array (PLA), or as another suitable hardware component that is embedded with a defined configuration set (e.g., instructions) for performing the disclosed functions.

Program code embodied on a computer-readable medium may be transmitted using any appropriate medium, including but not limited to wireless, wireline, optical fiber, cable, RF, etc., or any suitable combination of the foregoing. Computer program code for carrying out operations for aspects of the present arrangements may be written in any combination of one or more programming languages, including an object-oriented programming language such as Java™ Smalltalk, C++, and so on and conventional procedural programming languages, such as the "C" programming language or similar programming languages. The program code may execute entirely on the user's computer, partly on the user's computer, as a stand-alone software package, partly on the user's computer and partly on a remote computer, or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

The terms "a" and "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The phrase "at least one of . . . and . . . " as used herein refers to and encompasses any and all possible combinations of one or more of the associated listed items. As an example, the phrase "at least one of A, B, and C" includes A only, B only, C only, or any combination thereof (e.g., AB, AC, BC or ABC).

Aspects herein can be embodied in other forms without departing from the spirit or essential attributes thereof. Accordingly, reference should be made to the following claims, rather than to the foregoing specification, as indicating the scope hereof.

What is claimed is:

1. A traffic system comprising:

one or more processors;

a memory communicably coupled to the one or more processors and storing:

an aggregation module including instructions that when executed by the one or more processors cause the one or more processors to:

aggregate perception data associated with a road network from information sources to a server; and a graphing module including instructions that when executed by the one or more processors cause the one or more processors to:

generate a graph structure from the perception data in association with a neural network model, wherein the graph structure is an incomplete representation of the road network in view of missing data associated with the information sources;

complete the graph structure using the neural network model that forms a graph model of traffic flows, wherein completion of the graph structure includes using the neural network model to de-noise the graph structure according to road constraints between points in the road network; and communicate the graph model of the traffic flows to a vehicle to navigate in the road network.

2. The traffic system of claim 1, wherein the graphing module further includes instructions to clean the graph structure using the neural network model for error minimization and de-noising of the perception data according to the road constraints.

3. The traffic system of claim 1, wherein the graphing module includes instructions to complete the graph structure further including instructions to train the neural network model by updating parameter weights by error minimization and back-propagation of a derivate of a ground-truth associated with the graph model to stabilize the neural network model.

4. The traffic system of claim 1, wherein the graphing module includes instructions to complete the graph structure further including instructions to use fixed road properties between vertices by the neural network model to complete the graph structure, and wherein the vertices are intersections of the road network.

5. The traffic system of claim 1, wherein the graphing module includes instructions to generate the graph structure from the perception data further including instructions to remove duplicate data from the information sources according to at least one of: a location identifier and direction information.

6. The traffic system of claim 1, wherein the graphing module includes instructions to complete the graph structure further including instructions to satisfy a completion target in view of the missing data associated with the information sources.

7. The traffic system of claim 1, wherein the graph structure includes the perception data and a fixed geometry of the road network.

8. The traffic system of claim 1, wherein the graphing module includes instructions to generate the graph structure from the perception data further including instructions to use a confidence score that weights and normalizes the perception data related to a detection model or a measurement model associated with a perception data type.

9. A non-transitory computer-readable medium including instructions that when executed by one or more processors cause the one or more processors to:

aggregate perception data associated with a road network from information sources to a server;

generate a graph structure from the perception data in association with a neural network model, wherein the graph structure is an incomplete representation of the road network in view of missing data associated with the information sources;

complete the graph structure using the neural network model that forms a graph model of traffic flows, wherein completion of the graph structure includes using the neural network model to de-noise the graph structure according to road constraints between points in the road network; and communicate the graph model of the traffic flows to a vehicle to navigate in the road network.

10. The non-transitory computer-readable medium of claim 9 further comprising instructions that when executed by the one or more processors cause the one or more processors to clean the graph structure using the neural network model for error minimization and de-noising of the perception data according to the road constraints.

11. The non-transitory computer-readable medium of claim 9, wherein the instructions to complete the graph structure further include instructions to train the neural network model by updating parameter weights by error minimization and back-propagation of a derivate of a ground-truth associated with the graph model to stabilize the neural network model.

12. The non-transitory computer-readable medium of claim 9, wherein the instructions to complete the graph structure further include instructions to use fixed road properties between vertices by the neural network model to complete the graph structure, and wherein the vertices are intersections of the road network.

13. A method comprising:

aggregating perception data associated with a road network from information sources to a server;

generating a graph structure from the perception data in association with a neural network model, wherein the graph structure is an incomplete representation of the road network in view of missing data associated with the information sources;

completing the graph structure using the neural network model that forms a graph model of traffic flows, wherein completing the graph structure includes using the neural network model to de-noise the graph structure according to road constraints between points in the road network; and communicating the graph model of the traffic flows to a vehicle to navigate in the road network.

14. The method of claim 13, further comprising:

cleaning the graph structure using the neural network model for error minimization and de-noising of the perception data according to the road constraints.

15. The method of claim 13, wherein completing the graph structure further comprises training the neural network model by updating parameter weights by error minimization and back-propagation of a derivate of a ground-truth associated with the graph model to stabilize the neural network model.

16. The method of claim 13, wherein completing the graph structure further comprises using fixed road properties between vertices by the neural network model to complete the graph structure, and wherein the vertices are intersections of the road network.

17. The method of claim 13, wherein generating the graph structure from the perception data further comprises removing duplicate data from the information sources according to at least one of: a location identifier and direction information.

18. The method of claim 13, wherein completing the graph structure further comprises satisfying a completion target in view of the missing data associated with the information sources.

19. The method of claim 13, wherein the graph structure includes the perception data and a fixed geometry of the road network.

20. The method of claim 13, wherein generating the graph structure from the perception data further comprises using a confidence score that weights and normalizes the perception data related to a detection model or a measurement model associated with a perception data type.

* * * * *